US007004679B2

(12) United States Patent
Naka et al.

(10) Patent No.: US 7,004,679 B2
(45) Date of Patent: Feb. 28, 2006

(54) EASILY-CUTTABLE TUNNEL SEGMENT STRUCTURE

(75) Inventors: Ryoichi Naka, Tokyo (JP); Toshihiko Yoshizumi, Tokyo (JP); Shinichi Nakata, Nishinomiya (JP); Fumio Kondoh, Yao (JP); Seiichi Satoh, Tokyo (JP); Osamu Ishita, Tokyo (JP); Yutaka Fujino, Tokyo (JP); Tukasi Chiba, Tokyo (JP)

(73) Assignees: Nippon Steel Corporation, Tokyo (JP); Taisei Corporation, Tokyo (JP); GEOSTR Corporation, Tokyo (JP)

( * ) Notice: Subject to any disclaimer, the term of this patent is extended or adjusted under 35 U.S.C. 154(b) by 0 days.

(21) Appl. No.: 10/301,351

(22) Filed: Nov. 21, 2002

(65) Prior Publication Data

US 2003/0113168 A1 Jun. 19, 2003

(30) Foreign Application Priority Data

Dec. 13, 2001 (JP) ..... 2001-379756

(51) Int. Cl.
*E21D 11/08* (2006.01)
*E21D 9/08* (2006.01)

(52) U.S. Cl. ..... 405/139; 405/135; 405/153

(58) Field of Classification Search ..... 405/134, 405/135, 139, 146, 151, 152, 153
See application file for complete search history.

(56) References Cited

U.S. PATENT DOCUMENTS

| | | | | |
|---|---|---|---|---|
| 967,264 | A * | 8/1910 | Sydney | 405/153 |
| 3,818,710 | A * | 6/1974 | Chlumecky | 405/152 |
| 4,545,701 | A * | 10/1985 | Tsuzuki | 405/153 |
| 6,328,501 | B1 * | 12/2001 | Gimbert | 405/135 |

FOREIGN PATENT DOCUMENTS

JP 2751636 5/1998

* cited by examiner

*Primary Examiner*—Michael Safavi
(74) *Attorney, Agent, or Firm*—Kenyon & Kenyon

(57) ABSTRACT

The present invention relates to a novel easily-cuttable tunnel segment structure used for the departure of a shield machine from a main tunnel to a branch tunnel or the return to the main tunnel from the branch tunnel, and provides an easily-cuttable tunnel segment structure 1 constructed by connecting a plurality of easily-cuttable tunnel segment pieces 2 in the longitudinal direction of a tunnel, wherein at least an easily-cuttable area 3 is formed by concrete 7 in which easily-cuttable reinforcement members are arranged, and a join disposed at least in the easily-cuttable area 3 in the longitudinal direction has an easily-cuttable join structure.

9 Claims, 14 Drawing Sheets

EASILY-CUTTABLE TUNNEL SEGMENT STRUCTURE

BACKGROUND OF THE INVENTION

1. Field of the Invention

The present invention relates to a novel easily-cuttable tunnel segment structure used so that a shield machine can depart from a main tunnel or return to the main tunnel.

2. Description of the Related Art

When a branch tunnel branched from a main tunnel is constructed, the operational or safety risk becomes larger as the depth of a job site increases in the prior art and when, for example, carried out at an entrance of a vertical shaft for the start or arrival of the shield machine for the purpose of solidifying the ground or demolishing a wall of an opening part in the main tunnel. Particularly, when the shield machine departs upward, the end cutting is extremely difficult and dangerous.

Also, there is a branch shield construction method wherein a branch shield machine for constructing a branch tunnel is built into a main shield machine for constructing a main tunnel and departs from the main tunnel. However, according to this method, a space within the tunnel is restricted and the operation is limited to the construction of only one branch.

In this connection, as a prior art in which the shield machine directly departs from or directly arrives at the main tunnel after the main tunnel has been constructed by using easily-cuttable segments, the Japanese Patent No. 2751636 discloses the invention of a segment for a shield tunnel, manufactured by using cuttable chord members of carbon, aramid, glass or vinylon staple fibers or filaments impregnated with resin as a reinforcement material for concrete. However, in the above-mentioned Patent Publication, there is no disclosure necessary for putting this invention into practice as a basic concept; that is, there is no concrete structure or means for bonding a plurality of segments into an integral body.

On the other hand, the above-mentioned fiber-reinforced cuttable structure for the direct departure or arrival of the shield machine has already been widely used as various retaining walls such as a continuous underground wall, SMW or a caisson. When prefabricated concrete products are applied to such uses, however, they are used as piles arranged at a predetermined gap which is usually filled with concrete or mortar in a job site. In other words, a structure has not been obtained in which the fiber-reinforced prefabricated concrete pieces are tightly bonded together without gap to form a continuous shield opening solely thereby. Accordingly, it has been difficult to apply such a prior art, as it is, to a case wherein the shield machine directly departs from or arrives at the main tunnel.

As described above, the prior art invention does not propose concrete means for achieving the object of the direct departure of the shield machine from the main tunnel or the direct arrival thereof at the main tunnel by cutting the segment structure without demolishing the already constructed tunnel wall. Particularly, when it is necessary for the shield machine to depart upward from the main tunnel, the execution thereof is extremely difficult.

In this regard, there are the following problems to be solved in a case wherein the easily-cuttable portion is provided in the tunnel segment structure to form a branch of the main tunnel, from which the shield machine departs or at which it arrives.

1. Bonding of a Plurality of Segments

Generally speaking, when the shielding is carried out, segment pieces, prepared by dividing a curved surface forming a wall of the tunnel in the circumferential direction and the longitudinal direction, are assembled together in a rear part of the tunneling machine. In this case, to apply a cuttable structure to the wall of the main tunnel for the purpose of the departure or arrival of the tunneling machine for forming the branch tunnel, it is necessary to provide a segment formed of a cuttable material in an area somewhat larger than a diameter of the tunneling machine for forming the branch tunnel.

Generally speaking, a longitudinal length of the segment is approximately in a range from 1.0 to 1.5 m, while an outer diameter of the tunneling machine for the branch tunnel exceeds 2 m. Therefore, the cuttable segments provided in the main tunnel for the departure or arrival of the branch tunneling machine extend over a plurality of rings, which requires bonding between the segments and the rings.

All the bonded portions between the segments and the rings also have a structure cuttable by the tunneling machine. In addition to this, it is necessary that, until the branch tunnel is cut open, the adjacent segments are brought into tight contact with each other without a gap as a wall of the main tunnel similar to ordinary segments forming a permanent structure. Also, it is necessary that a non-cut portion of the segment has the strength of a permanent structure.

2. Water-Proofness

To prevent underground water from entering from the ground upon the departure or arrival of the shield machine, it is necessary to provide an entrance part into which a portion of the shield machine from a face plate to a front portion of a skin plate can penetrate.

However, this entrance part is not connectable in advance to the segment due to the spatial restriction when the easily-cuttable segment is assembled into the main tunnel. Accordingly, it is desirable to provide a structure in the segment for forming a base portion to be bonded to the entrance part after the segment has been assembled.

On the other hand, when crack generates during the cutting operation in the concrete of the cuttable segment which is put into practice, by the tunneling machine, there is a risk in that pressurized muddy water in the chamber of the shield machine or underground water in the background may enter the main tunnel via the crack. Thus, a structure and means for preventing such a problem is necessary.

SUMMARY OF THE INVENTION

The present invention provides a novel easily-cuttable tunnel segment structure and a method for laying the same in a branch tunnel satisfying the above-mentioned requirements.

(1) A first invention is an easily-cuttable tunnel segment piece 2 for forming one piece of a tunnel segment structure; said tunnel structure having an area 3 to be cut extending over a plurality of said tunnel segment pieces connected to each other in the longitudinal direction of a tunnel; wherein at least the easily-cuttable area 3 is formed by concrete 7 in which easily-cuttable reinforcement members 6 are arranged, and a join disposed at least in the easily-cuttable area 3 in the longitudinal direction has an easily-cuttable join structure.

(2) A second invention is an easily-cuttable tunnel segment piece 2 as defined by item 1, wherein said join structure consists of an easily-cuttable male type join 20 comprising a connection rod 18 having a male thread at one end to be engaged with a female thread portion 19 of one segment and an easily-cuttable female type join 21 provided in the other segment.

(3) A third invention is an easily-cuttable tunnel segment piece 2 as defined by item 1 or 2, wherein an embedded steel plate 22 capable of fixing an entrance body is provided at a boundary between the area 3 to be cut and an non-cut area 5 in the inner circumference of the segment; said steel plate being projected and exposed above the inner circumference of the segment.

(4) A fourth invention is an easily-cuttable tunnel segment piece 2 as defined by any one of items 1 to 3, wherein fiber-reinforced material containing at least one kind of steel, resin, glass or FRP is kneaded or mixed to the concrete 7.

(5) A fifth invention is an easily-cuttable tunnel segment piece 2 as defined by any one of items 1 to 4, wherein main beams 8, join plates 9 and skin plates 10, all of which are made of steel are provided in the non-cut area.

(6) A sixth invention is an easily-cuttable tunnel segment piece 2 as defined by item 5, wherein reinforcement member 6 and the join plate 9 disposed at a circumferential end of the segment are connected together by a lap join structure between the reinforcement member 6 and a join iron chord member 15*a*.

(7) A seventh invention is an easily-cuttable tunnel segment piece 2 as defined by item 5, wherein the reinforcement member 6 and the join plate 9 disposed at a circumferential end of the segment are connected together by a sheath-like jig 16.

(8) An eighth invention is an easily-cuttable tunnel segment piece 2 as defined by any one of items 1 to 7, wherein a gripper located in the area to be cut is formed of easily-cuttable material.

(9) An ninth invention is an easily-cuttable tunnel segment structure 1 constructed by connecting a plurality of the easily-cuttable tunnel segment pieces 2 defined by any one of items 1 to 8 in the longitudinal direction of a tunnel.

(10) A tenth invention is an easily-cuttable tunnel segment structure wherein exposed portions of the embedded steel plates 22 in the adjacent segment pieces 2 defined by any one of items 3 to 8 are welded and connected together, and an entrance body is welded and fixed to the exposed portions of the embedded steel plates 22.

(11) An eleventh invention is a method for constructing a branch tunnel, wherein the easily-cuttable tunnel segment structure 1 defined by item 9 or 10 is used in a tunnel entrance for the departure or arrival of a tunneling machine 32.

DETAILED DESCRIPTION OF THE PREFERRED EMBODIMENTS

Figure 1A:
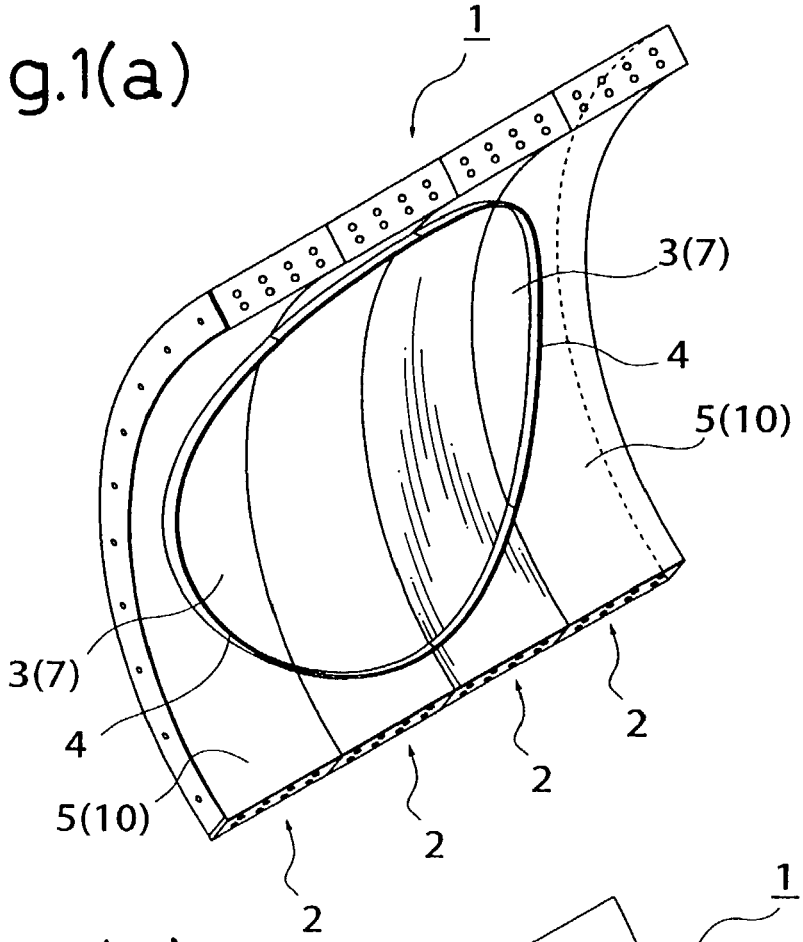
FIG. 1 illustrates an easily-cuttable tunnel segment structure formed by connecting a plurality of easily-cuttable tunnel segment pieces to each other.
Figure 1B:
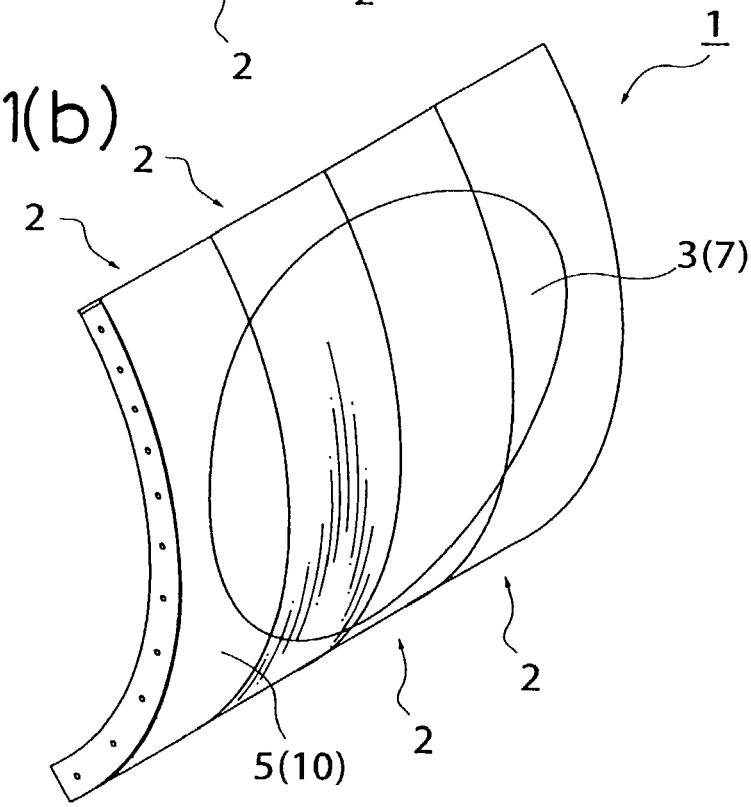
Figure 2:
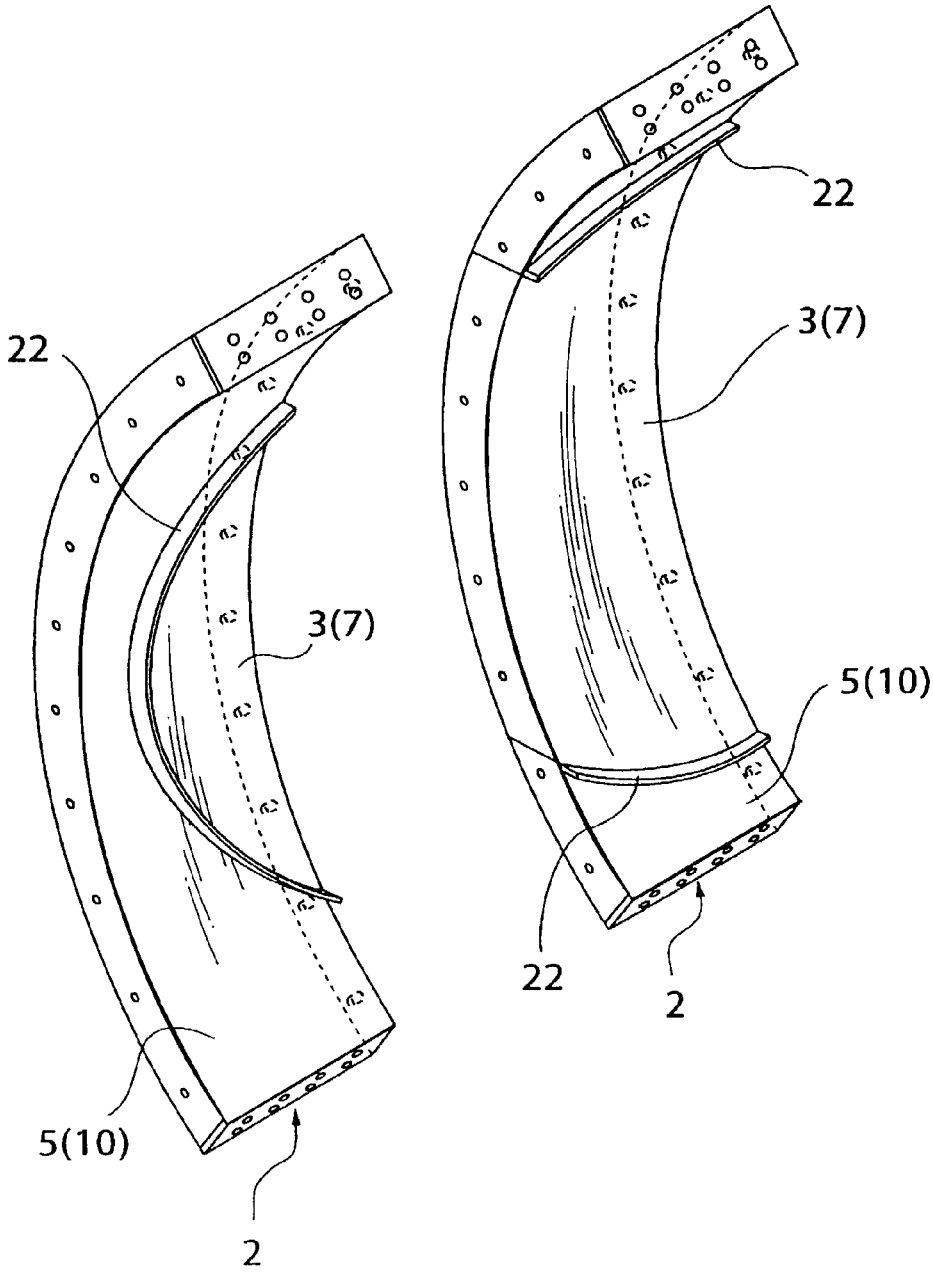
FIG. 2 illustrates the relationship between the easily-cuttable segment pieces to be bonded together.

FIG. 1 illustrates an easily-cuttable tunnel segment structure 1 formed by connecting a plurality of easily-cuttable tunnel segment pieces 2 to each other; and FIG. 2 illustrates the relationship between the easily-cuttable segment pieces 2 to be bonded together.

The easily-cuttable tunnel segment structure 1 is formed by connecting a plurality of easily-cuttable tunnel segment pieces 2 (hereinafter referred to as segment pieces) to each other in the longitudinal direction of the tunnel so that an area 3 of the easily-cuttable tunnel segment structure 1 to be cut (corresponding to an area to be tunneled by a shield machine 32 for forming a branch tunnel) extends over the plurality of segment pieces 2. An annular entrance fixing part 4 made of steel is provided to encircling the area 3 to be cut so that an entrance part 32*a* is welded and fixed thereto.

Figure 3:
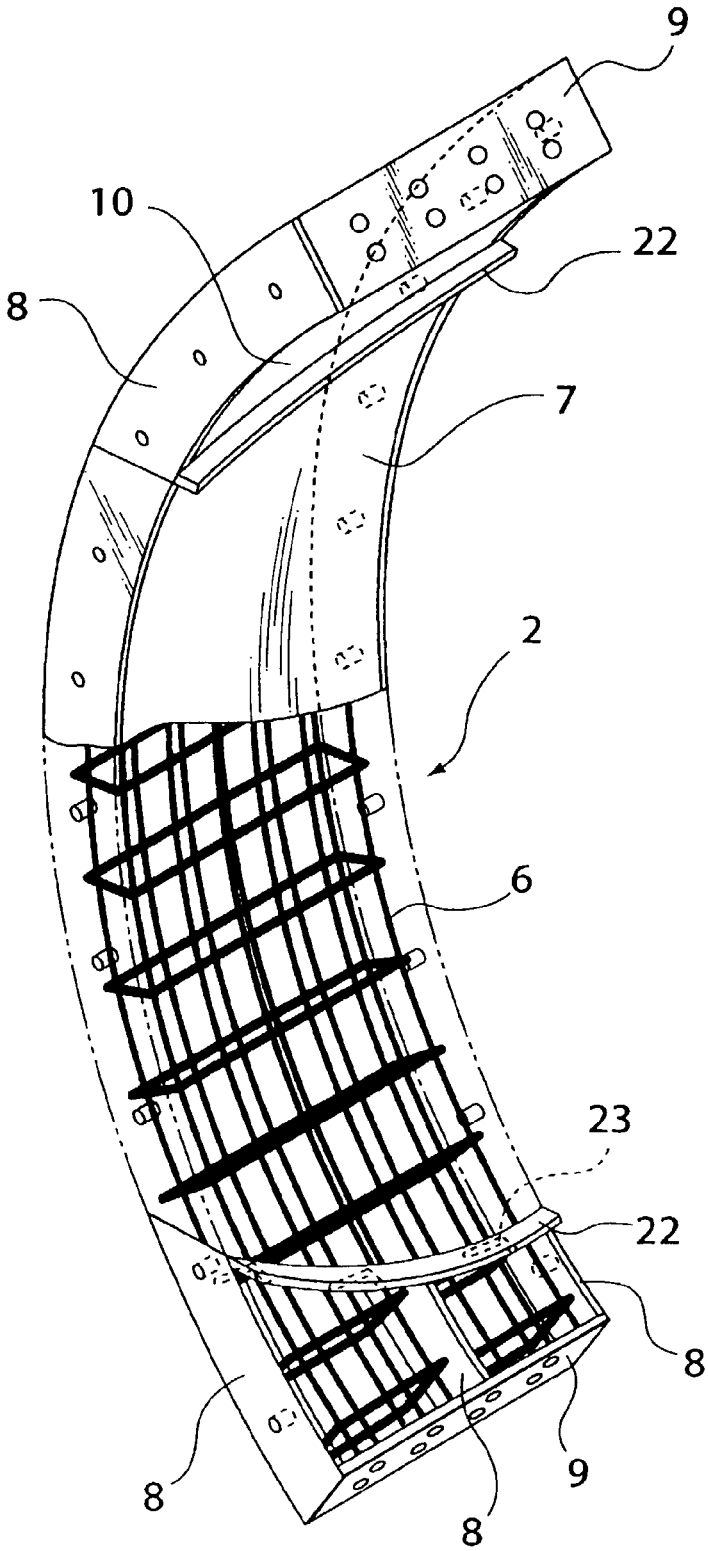
FIG. 3 is a partially broken perspective view of the easily-cuttable segment piece constructing the easily-cuttable tunnel segment structure.
Figure 4:
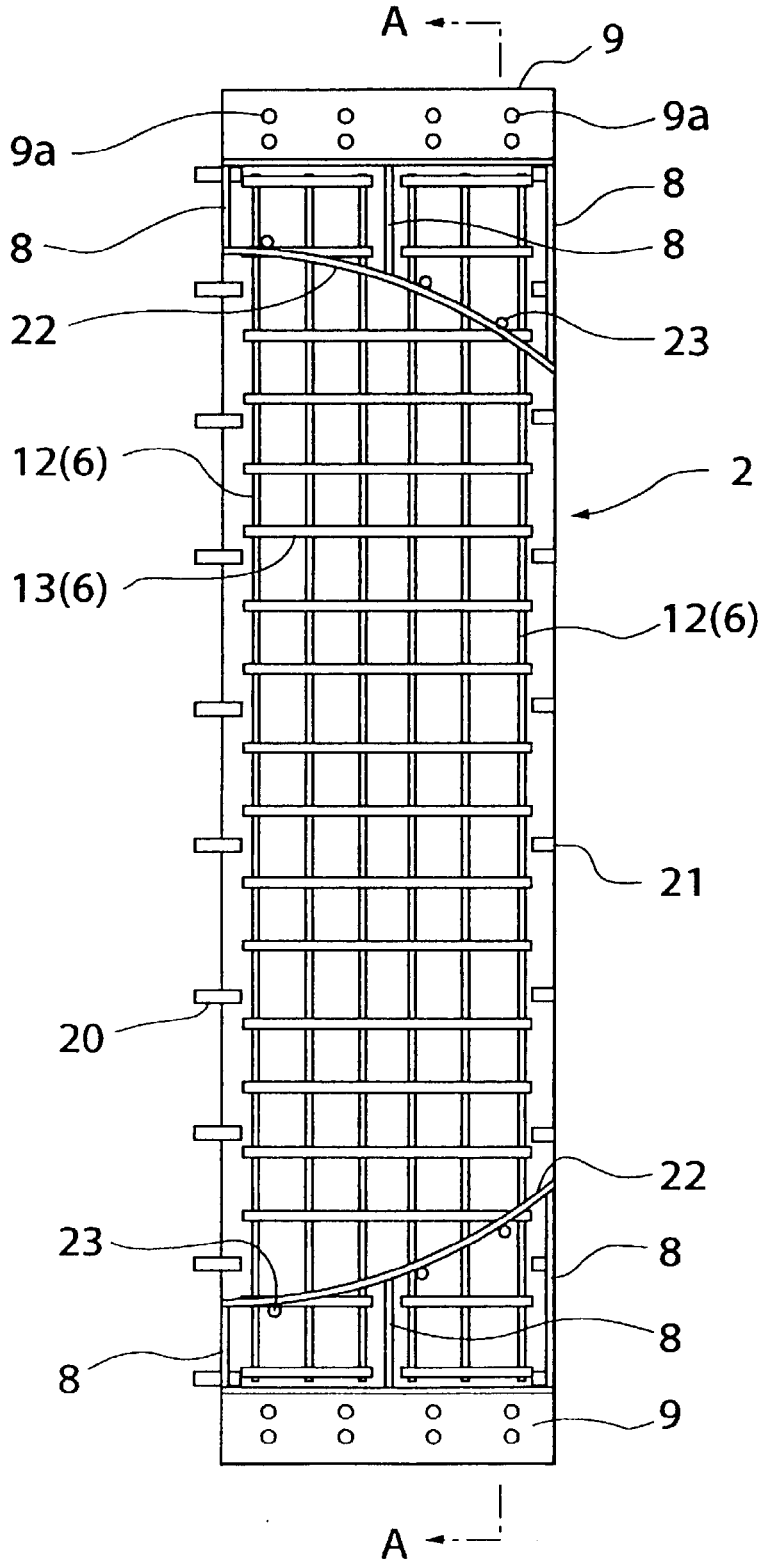
FIG. 4 is a plan view illustrating the arrangement of reinforcement chord members in the easily-cuttable segment piece.
Figure 5:
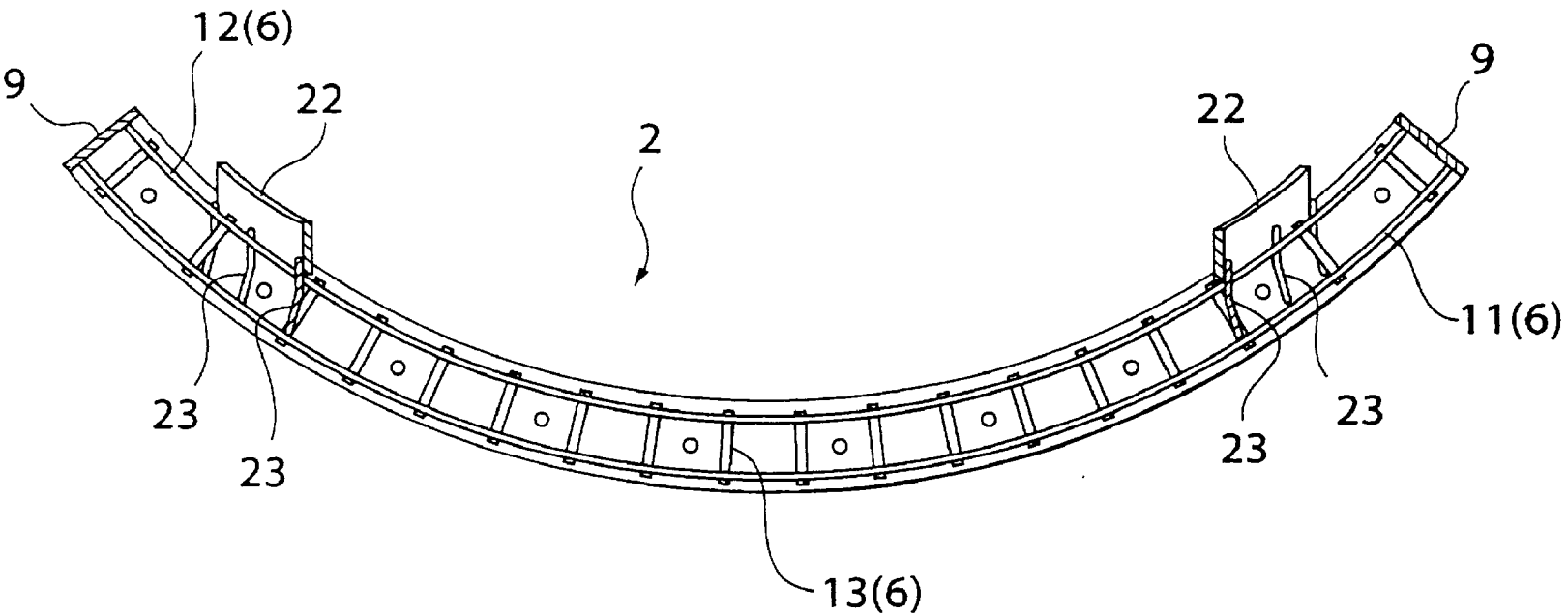
FIG. 5 is a sectional view taken along a line A—A in FIG. 4.

FIG. 3 is a partially broken perspective view of the easily-cuttable segment piece 2 constructing the easily-cuttable tunnel segment structure 1. Also, FIG. 4 is a plan view illustrating the arrangement of reinforcement chord members 6 in the easily-cuttable segment piece 2, and FIG. 5 is a sectional view taken along a line A—A in FIG. 4. The segment piece 2 according to the present invention is a concrete structure having easily-cuttable reinforcement chord members 6 therein. Concrete 7 having the reinforcement chord members 6 therein is exposed as it is in the area 3 of the segment piece 2 to be cut, but a surface of a non-cut area 5 of the segment piece 2 is encircled by main beams 8, join plates 9 and skin plates 10, all of which are made of steel and welded to cover the outer circumference of this area in a box shape.

The reinforcement chord members 6 within the segment piece 2 are formed by curved rod-like upper chord members 11 and lower chord members 12 arranged in the vertical direction of the segment (the circumferential direction of the tunnel) and stirrups 13 arranged in the horizontal direction (the longitudinal direction of the tunnel) and extending transverse to the upper and lower chord members 11 and 12. As these reinforcement chord members 6 (the upper chord members 11, the lower chord members 12 and the stirrup 13) must be cut by the shield machine 32, they are made of easily-cuttable material such as fiber-reinforced plastic (generally referred to as FRP) containing, for example, glass fibers, carbon fibers or aramid fibers. Of them, CFRP (carbon fiber-reinforced plastic) is particularly preferable.

Figure 6:
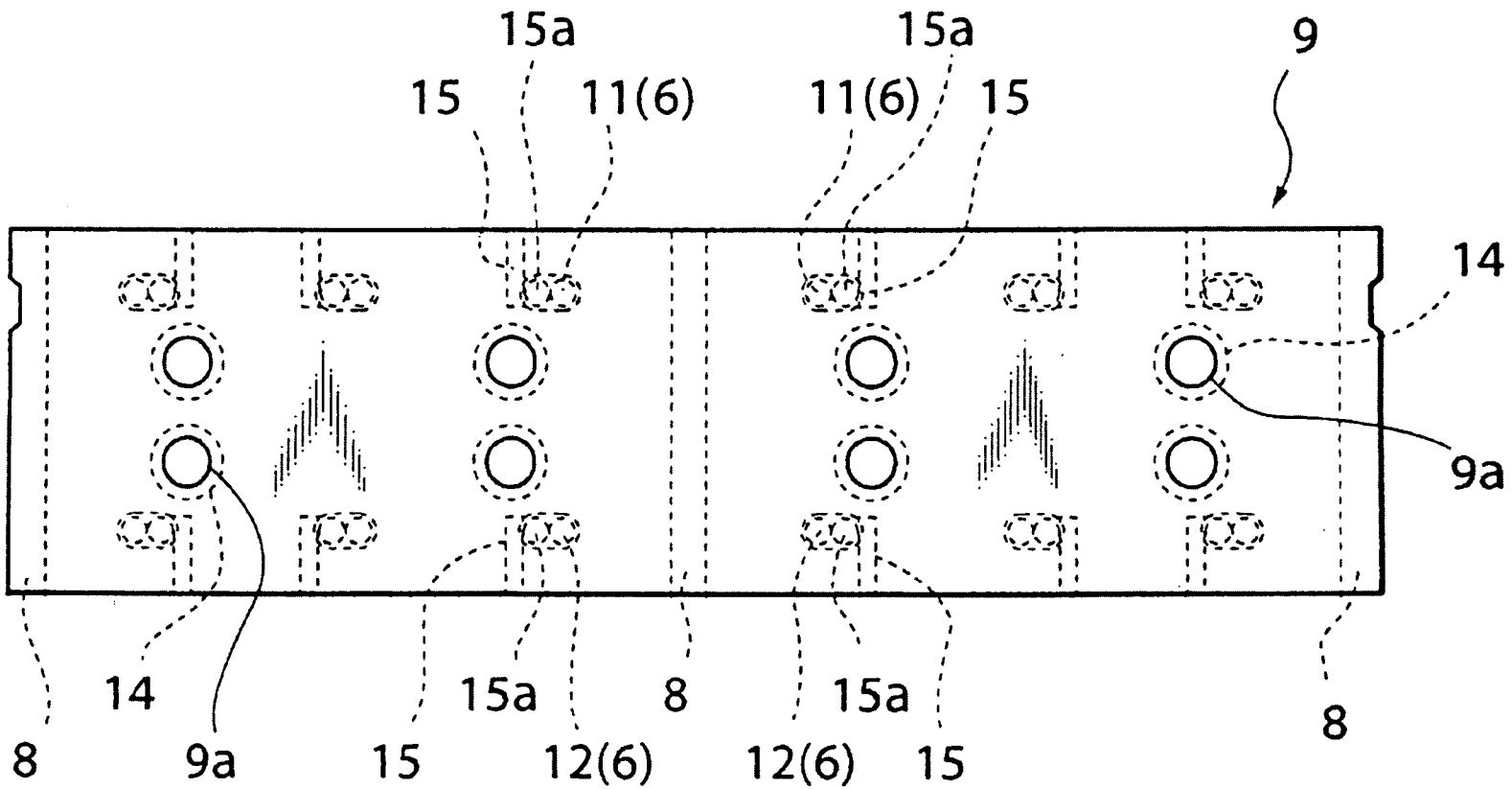
FIG. 6 illustrates one embodiment of a structure for fixing upper chord members, lower chord members and steel join plates to each other at a circumferential end of the segment.
Figure 7:
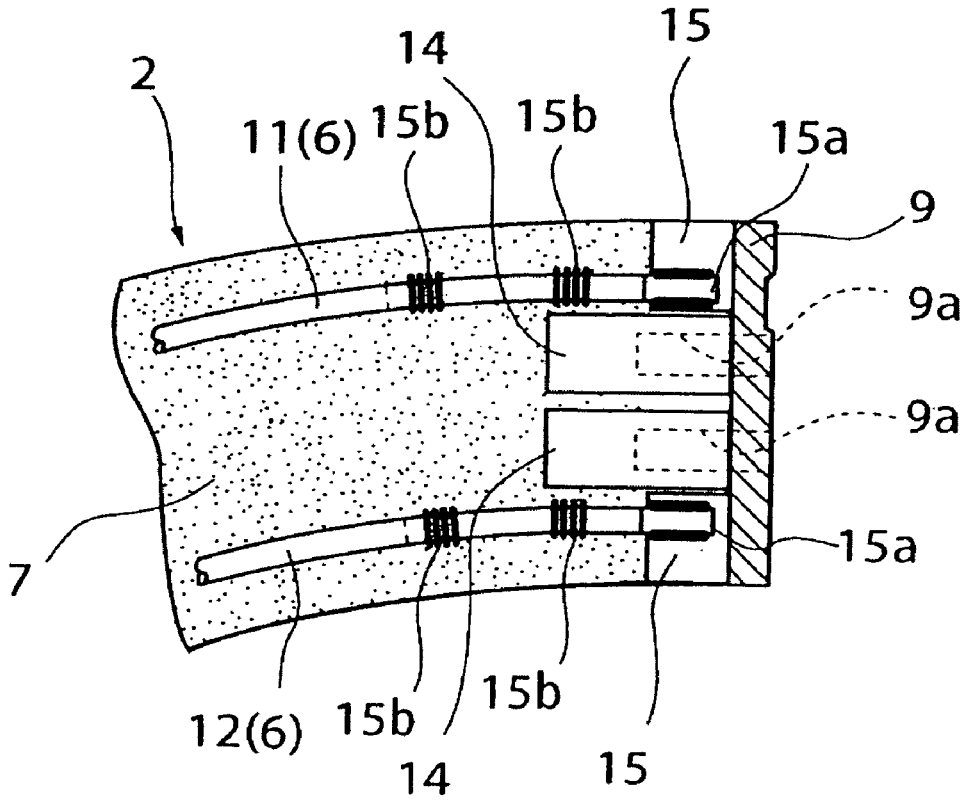
FIG. 7 is a sectional view taken in the circumferential direction of FIG. 6.
Figure 8:
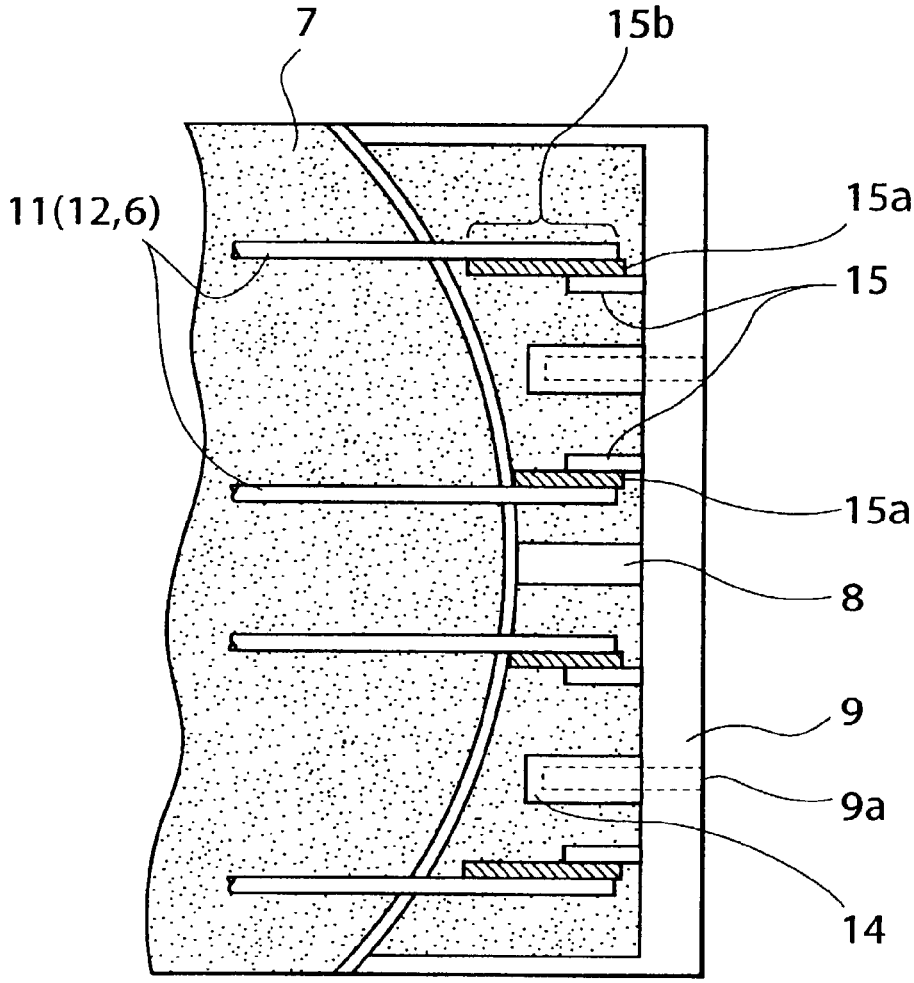
FIG. 8 is a plan view of the segment shown in FIG. 6.

FIGS. 6, 7 and 8 illustrate one embodiment of a structure for fixing the upper chord members 11, the lower chord members 12 and the steel join plates 9 to each other at a circumferential end of the segment.

The steel join plate 9 has a plurality of join holes 9*a* for the connection with another segment adjacent in the circumferential direction and sheath members 14 are fixed in the steel join plate 9 on the inner side of the segment for the backup of the respective join holes 9*a*. Also, a plurality of reinforcement steel plate pieces 15 extending vertically to the steel join plate 9 are arranged in upper and lower rows and welded thereto. A join iron chord member 15*a* is welded to the reinforcement steel plate piece 15 in the circumferential direction of the tunnel. The upper chord member 11, the lower chord member 12 and the join iron chord member 15*a* are connected together by a lap join 15*b* so that the stress is sufficiently transferred to an exterior structure from the reinforcement chord members within the segment.

Figure 9:
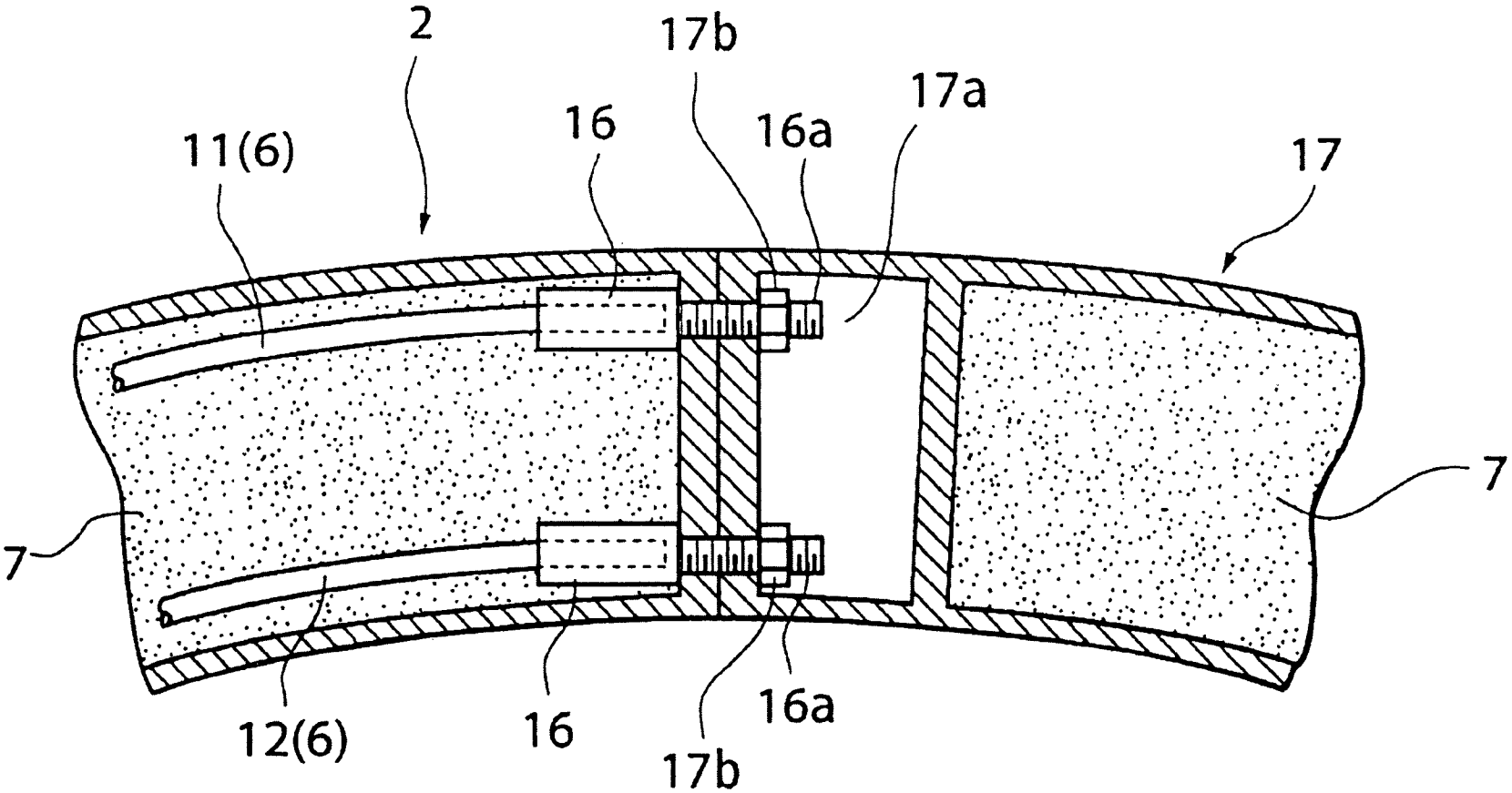
FIG. 9 illustrates another embodiment of a structure for fixing upper chord members, lower chord members and steel join plates to each other at a circumferential end of the segment.

FIG. 9 illustrates another embodiment of a structure for fixing the upper chord members 11, the lower chord members 12 and the steel join plates 9 to each other at a circumferential end of the segment.

In the embodiment shown in FIG. 9, an end of the upper chord member 11 and the lower chord member 12 is inserted into a sheath-like jig 16 having a bolt so that the steel join plate 9 is connected with a bolt box 17*a* of the adjacent segment 17 by a bolt 16*a* of the sheath-like jig 16. Also in this case, the upper chord member 11 and the lower chord member 12 are connected to a box-like steel shell at an end of the segment by the sheath-like jig 16 having a bolt so that the stress is sufficiently transferred to an exterior structure from the reinforcement chord members within the segment.

Also, since the area 3 to be cut extends over the plurality of segment pieces 2 in the present invention, the inter-segment join structure may be provided in the area 3 to be cut. However, if the join structure made, for example, of steel is disposed in the area 3 to be cut, the cutting operation may become difficult, or even impossible, in some cases. Accordingly, it is necessary that the join arranged in the area 3 to be cut in parallel to the longitudinal direction of the tunnel has an easily-cuttable join structure.

Figure 10:
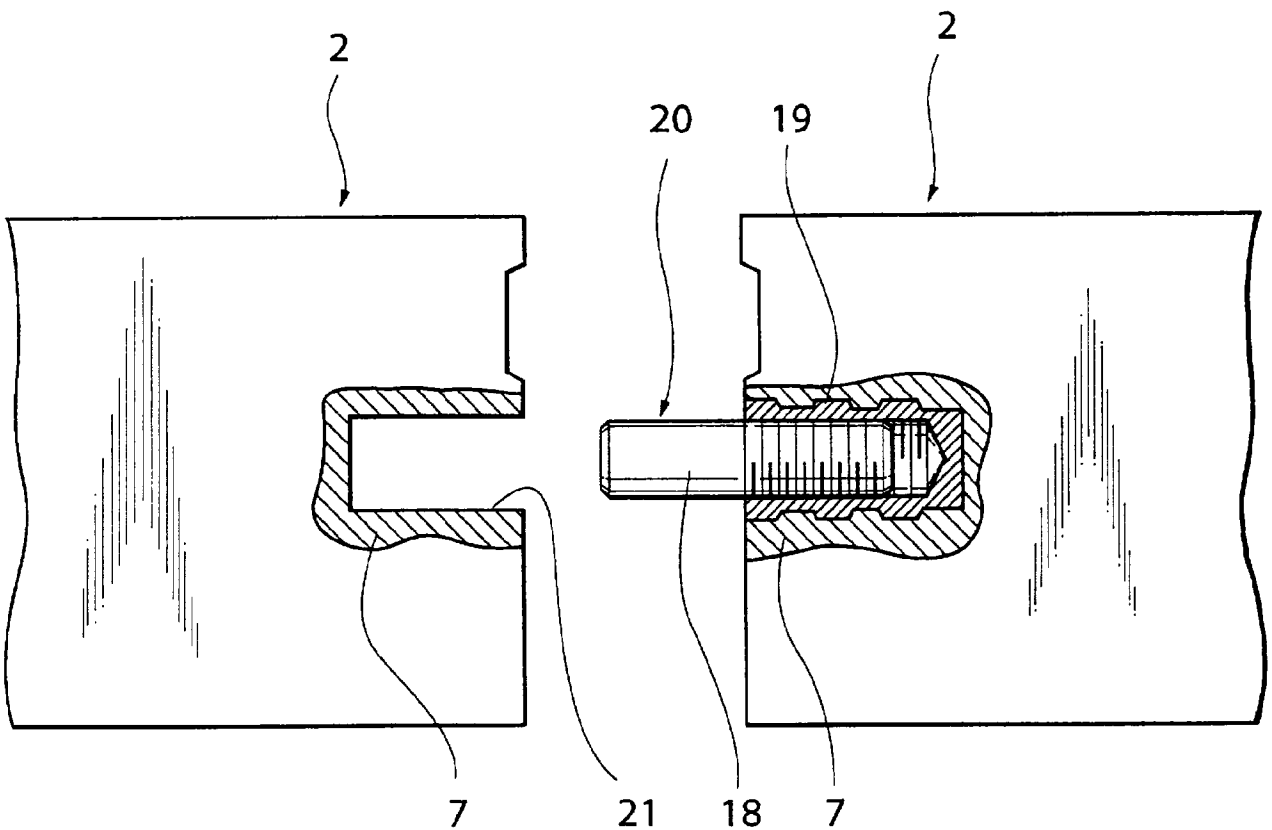
FIG. 10 illustrates one embodiment of an easily-cuttable join structure in the longitudinal direction of the segment.

FIG. 10 illustrates one embodiment of the easily-cuttable join structure using rod-like join 18 made of FRP having a threaded portion at one end.

If a sheath 19 made of FRP having a female thread in the interior thereof is embedded in one end of the segment piece and is screw-engaged with the rod-like join 18, a male type join 20 is formed. While, a female type join 21 having an inner diameter somewhat larger than an outer diameter of the rod-like join 19 is provided at an end of another segment at a position corresponding to the male type join 20 so that the connection between the adjacent segment pieces is enhanced by the engagement of the male type join 20 with the female type join 21. A gap between the male type join 20 and the female type join 21 is preferably filled with a settable grout and bonded thereby. This method is particularly effective when a thickness of the segment is small.

It should be noted, however, that the join structure shown in FIG. 10 is a mere example and other type easily-cuttable join structure may be adopted in which a bolt box is made of FRP and the segment pieces are fastened together by using FRP bolt and nut (not shown).

Limestone or light-weight aggregate is preferably used as a coarse aggregate for the concrete 7 of the segment piece 2 to facilitate the cutting operation. Also, fiber-reinforced material containing at least one kind of steel, resin, glass or FRP is preferably kneaded or mixed to the concrete 7 for the segment piece 2, because it is possible to increase a bending strength of the concrete, as well as minimizing a chip size of the concrete, without deteriorating the ease of the cutting concrete.

In a boundary region between the area 3 to be cut and the non-cut area 5 on the inner circumference of the segment piece 2, an embedded steel plate 22 having a shape in conformity with an outer circumference of the shield machine 32 is arranged while slightly protruded above the inner circumferential surface of the segment piece 2. This embedded steel plate 22 is made integral with the steel skin plate 10 by welding to form a box-like cover for the non-cut area 5 of the segment piece 2.

When the easily-cuttable tunnel segment structure 1 is formed, the protrusions of the embedded steel plates 22 of the adjacent segment pieces 2 are welded and fixed together and an entrance body made of steel is further welded thereon so that the entrance fixing part 4 is formed for welding the entrance part 32*a* of the shield machine as a whole.

It is not preferable that the embedded steel plate 22 is excessively deeply inserted into the concrete, because the concrete 7 is separated between the area 3 to be cut and the non-cut area 5 in the interior of the segment. Accordingly, the embedded steel plate 22 is preferably fixed to the concrete 7, while minimizing a depth thereof to be inserted into the concrete 7, by welding one end of an anchor iron chord member 23 to the embedded steel plate 22 and deeply inserting the other end of the anchor iron chord member 23 into the concrete 7 in the non-cut area 5 (see FIG. 5).

In this regard, in the prior art, a threaded steel pipe or cast iron member is embedded as a gripper into the segment piece 2 which is then suspended by an erector of the shield machine and transferred to a predetermined position at which the assembly is carried out. However, similar to the join structure, if the gripper made of steel or the like is disposed in the area 3 to be cut, the cutting operation may become difficult, or even impossible in some cases. Accordingly, when it is necessary to provide the gripper in the area 3 to be cut, the gripper is preferably made of easily-cuttable material such as FRP or others so that the safety of the segment piece 2 is guaranteed during the suspension thereof (not shown).

The segment piece 2 according to the present invention thus formed has the reinforcement chord member 6 in the interior thereof made of easily-cuttable material such as CFRP, and has the join members, disposed in the area 3 to be cut, also made of easily-cuttable material. That is, the area 3 of the segment piece to be cut is easily cut by the shield machine and has the strength of a structural product.

On the other hand, in the non-cut area 5 of the segment piece, the same concrete structure as that in the area 3 to be cut is covered with a box-like steel member so that no concrete 7 is exposed on and of the ground surface, the inner surface of the tunnel or the segment join surface. Further, the entrance fixing part 4 is integral with the box-like steel member covering the non-cut area 5 of the segment piece by welding. That is, when the branch tunnel is formed by the shield machine, the pressurized water is prevented from leaking out the inner surface of the tunnel. In this regard, the box-like steel cover member is subjected to the welding for the purpose of preventing water from leaking out of the join of the segment in the longitudinal direction of the tunnel. Since the main beam made of steel 8 and the skin plate 10 are provided in the non-cut area 5, it has a strength equal to that of a segment other than a portion in which the branch tunnel is formed.

Then, processes for forming a branch tunnel using the easily-cuttable tunnel segment will be sequentially explained with reference to FIGS. 11 to 14. In this embodiment, the shield machine 32 is made to depart upward from the main tunnel, which is very difficult in the prior art. Note this embodiment is a mere example because the division of the machine or the attachment of the entrance part is different, in timing at every job site.

(A) The easily-cuttable tunnel segment structure according to the present invention is located at a position from which a branch tunnel is to be formed (in this embodiment, on the upper side) to form a tunnel segment 30 for a main tunnel. When the easily-cuttable tunnel segment structure is constructed, the entrance fixing part 4 is formed by welding the protrusions of the embedded steel plates in the adjacent easily-cuttable tunnel segment pieces to each other and further welding the entrance body. Regarding the other items, it is possible to assemble them in the usual manner. The segments for the main tunnel other than those in the portion in which the branch tunnel is to be formed are ordinary ones (such as steel segments, ductile or RC segments, or synthetic segments).

Figure 11:
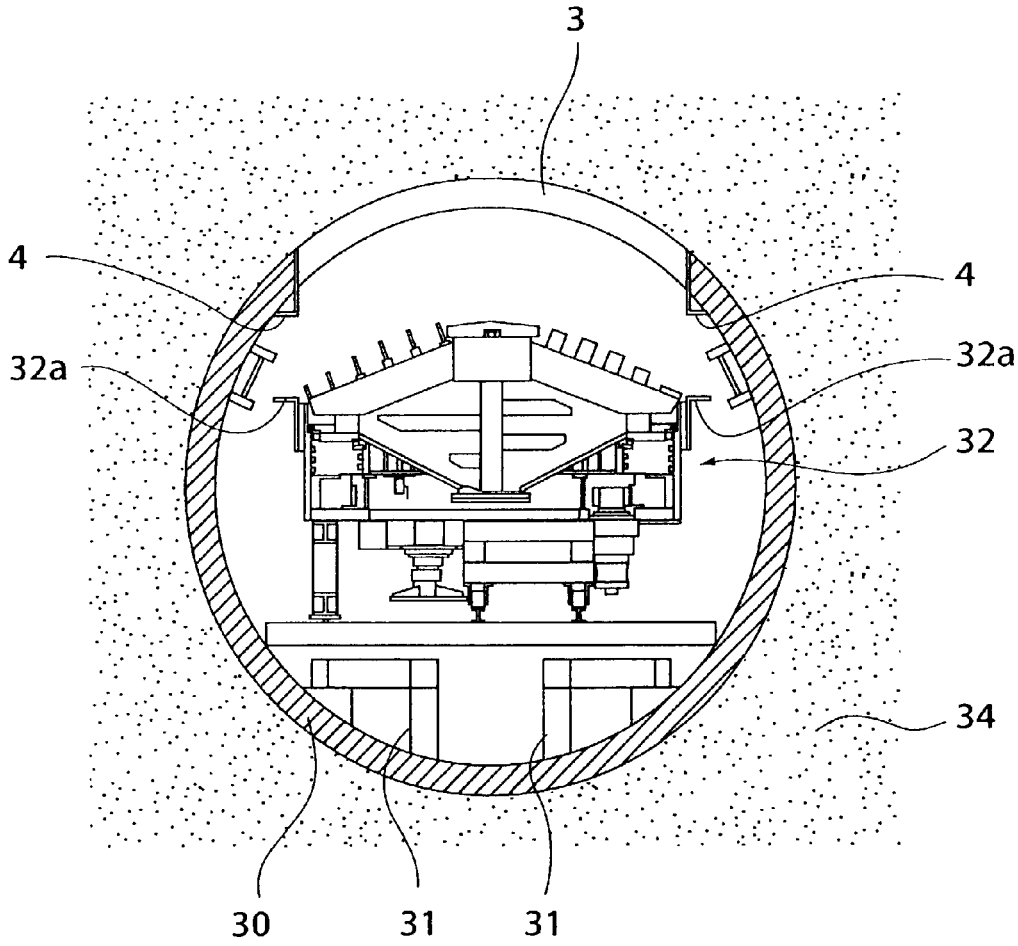
FIG. 11 illustrates a process for forming a branch tunnel using an easily-cuttable tunnel segment structure according to the present invention representing an initial stage of the shield machine.

Reactive force-receiving frames 31 are provided in the portion in which the branch tunnel is to be formed, and a front body of the shield machine 32 is installed thereon (see FIG. 11).

Figure 12:
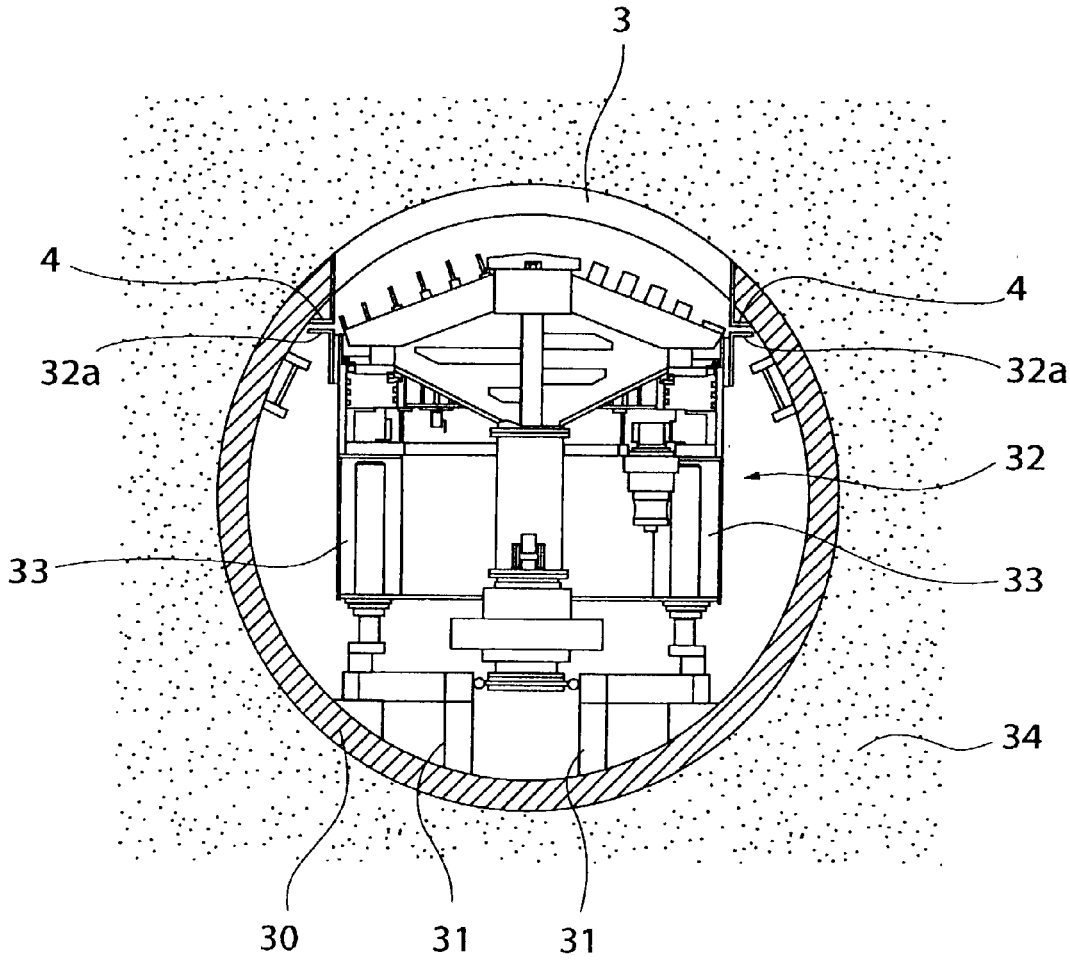
FIG. 12 illustrates a process for forming a branch tunnel using an easily-cuttable tunnel segment structure according to the present invention representing the shield machine lifted by a jack.

(B) Then, the front body of the shield machine 32 is lifted by a jack to assemble a middle body of the shield machine 32 and shield jacks 33 are transferred to a normal position (see FIG. 12).

Figure 13:
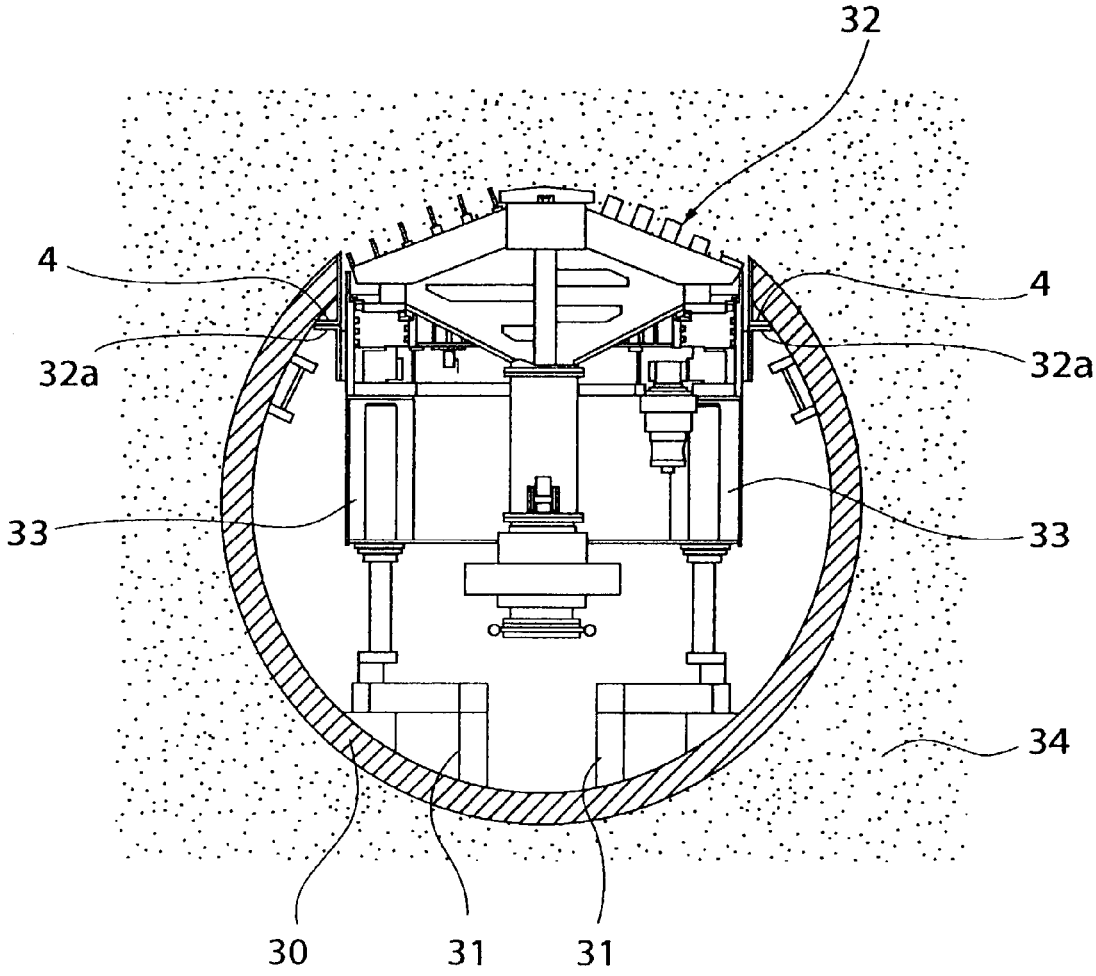
FIG. 13 illustrates a process for forming a branch tunnel using an easily-cuttable tunnel segment structure according to the present invention representing the shield machine being welded to the entrance fixing part and removal of the easily-cuttable tunnel segment structure.
Figure 14:
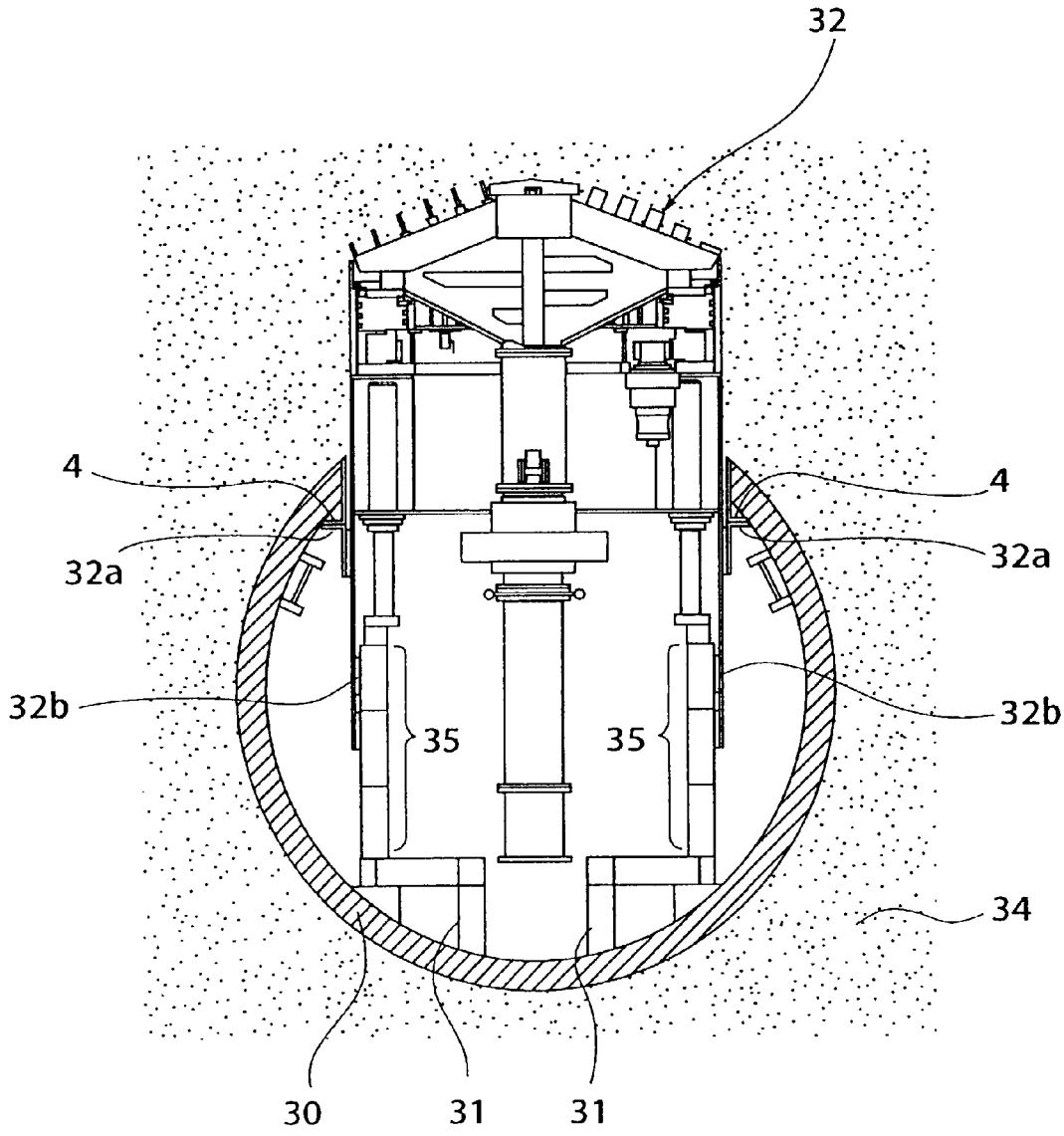
FIG. 14 illustrates a process for forming a branch tunnel using an easily-cuttable tunnel segment structure according to the present invention representing the shield machine removing further earth and sand.

(C) After the entrance part 32*a* of the shield machine is welded to the entrance fixing part 4 of the easily-cuttable tunnel segment structure, the shield jacks 33 are lifted upward so that the area 3 of the easily-cuttable tunnel segment structure to be cut is cut off (see FIG. 13).

(D) Further, earth and sand 34 is removed by the shield machine 32 and temporary segments 35 are constructed beneath the jacks 33. Then, a tail seal 32*b* is attached to the outside of the temporary segment 35 to complete the installation of the shield machine 32 (see FIG. 14).

The present invention should not be limited to the process for forming the upward branch tunnel. That is, all cases wherein the branch tunnel is formed by using the easily-cuttable tunnel segment structure according to the present invention are included within a technical scope of the present invention.

As described above, the shielding or tunneling method using the easily-cuttable tunnel segment structure according to the present invention is high in safety and effortless in term of work because it is unnecessary to demolish the segment in the tunnel or use an additional process. Particularly, the merit in the security of execution and the cost of construction becomes larger as the depth of the job site increases. Further, the effect of the present invention is significant when the upward tunnel is formed. Also, the present invention is advantageous when a branch tunnel or a vertical shaft is constructed by the shielding or tunneling method in which the shield machine departs from or arrives at the shield tunnel already formed, because the tunneling construction can be simultaneously carried out at a plurality of positions by installing the easily-cuttable tunnel segment structures in advance.

What is claimed:

1. A tunnel segment structure for a tunnel comprising:

a plurality of tunnel segment pieces connected to each other in the longitudinal direction of the tunnel, said plurality of tunnel segment pieces having an area to be cut extending over said plurality of tunnel segment pieces;

each of said plurality of tunnel segment pieces having said area to be cut being formed of concrete;

at least in said area to be cut in each of said plurality of tunnel segment pieces, a plurality of curved fiber-reinforced plastic rod chord members are disposed in the said concrete in the circumferential direction of the tunnel and a plurality of fiber-reinforced plastic stirrups are disposed in said concrete in the longitudinal direction of the tunnel;

fiber-reinforced plastic joins connecting in the longitudinal direction of the tunnel adjacent tunnel segment pieces of said plurality of tunnel segment pieces having said area to be cut;

a steel plate structure embedded in said concrete of said plurality of tunnel segment pieces having said area to be cut at an outer perimeter of said area to be cut, whereby said steel plate structure surrounds said area to be cut and is located at a boundary between said area to be cut and a non-cut area;

said steel plate structure embedded in said concrete at an inner circumferential surface of each of said plurality of tunnel segment pieces having said area to be cut, with said steel plate structure projected and exposed above said inner circumferential surface.

2. A tunnel segment structure according to claim 1, wherein said fiber-reinforced plastic rod cord members are carbon fiber-reinforced plastic, said fiber-reinforced plastic stirrups are carbon fiber-reinforced plastic, and said fiber-reinforced plastic joins are carbon fiber-reinforced plastic joins.

3. A tunnel segment structure according to claim 1, wherein said fiber-reinforced plastic join structure includes:

a male fiber-reinforced plastic join comprising a fiber-reinforced plastic rod having a male thread engaged with a female thread portion embedded in the concrete of one tunnel segment piece of said plurality of tunnel segment pieces having said area to be cut and a female fiber-reinforced plastic join embedded in the concrete of an adjacent tunnel segment piece of said plurality of tunnel segment pieces having said area to be cut.

4. A tunnel segment structure according to claim 1, wherein the concrete of each of said plurality of said tunnel segment pieces having said area to be cut has fiber reinforcing material select from the group consisting of at least one of steel, resin, glass and fiber-reinforced plastic kneaded or mixed in the concrete.

5. A tunnel segment structure according to claim 1, wherein said non-cut area of said plurality of tunnel segment pieces is provided with steel main beams, steel join plates and steel skin plates.

6. A tunnel segment structure according to claim 5, wherein a portion of fiber-reinforced plastic rod chord members located at a circumferential end at said non-cut area of said tunnel segment pieces having said area to be cut are connected to steel join plates at the circumferential end at said non-cut area of said tunnel segment pieces having said area to be cut by a lap joint between said portion of a respective fiber-reinforced plastic rod chord member and a join iron chord member connected to a respective steel join plate.

7. A tunnel segment structure according to claim 5, wherein a portion of fiber-reinforced plastic rod chord members located at a circumferential end at said non-cut area of said tunnel segment pieces having said area to be cut are connected to steel join plates at the circumferential end at said non-cut area of said tunnel segment pieces having said area to be cut by a sheath-like jig connecting said portion of a respective fiber-reinforced plastic rod chord member to a respective steel join plate.

8. A tunnel segment structure according to claim 1, wherein a steel annular entrance fixing part encircles said outer perimeter of said area to be cut of said plurality of tunnel segment pieces.

9. A method for constructing a branch tunnel comprising cutting said area to be cut in said plurality of connected tunnel segment pieces according to claim 1 with a shield machine thereby providing a branch tunnel entrance for departure or arrival of a tunneling machine.

* * * * *